US011306716B2

(12) United States Patent
Bell

(10) Patent No.: US 11,306,716 B2
(45) Date of Patent: Apr. 19, 2022

(54) PUMP

(71) Applicant: Michael L. Bell, Fullerton, CA (US)

(72) Inventor: Michael L. Bell, Fullerton, CA (US)

( * ) Notice: Subject to any disclaimer, the term of this patent is extended or adjusted under 35 U.S.C. 154(b) by 298 days.

(21) Appl. No.: 16/541,038

(22) Filed: Aug. 14, 2019

(65) Prior Publication Data

US 2021/0048024 A1 Feb. 18, 2021

(51) Int. Cl.

*F04C 11/00* (2006.01)
*F04C 2/16* (2006.01)
*F04C 18/16* (2006.01)

(52) U.S. Cl.

CPC ..... *F04C 11/008* (2013.01); *F04C 2/16* (2013.01); *F04C 18/16* (2013.01); *F04C 2240/30* (2013.01)

(58) Field of Classification Search

CPC ..... F04C 2/16; F04C 11/008; F04C 18/16; F04C 2240/30

See application file for complete search history.

(56) References Cited

U.S. PATENT DOCUMENTS 4,089,624 A * 5/1978 Nichols ..... B01L 3/0206 417/362
5,920,006 A * 7/1999 Zelechonok ..... G01N 30/32 73/61.56
6,257,052 B1 * 7/2001 Zelechonok ..... B01D 15/08 417/494
2005/0019187 A1 * 1/2005 Whitworth ..... F04B 7/0007 417/532
2005/0020980 A1 * 1/2005 Inoue ..... A61M 39/10 604/152

* cited by examiner

*Primary Examiner* — Patrick Hamo
(74) *Attorney, Agent, or Firm* — Michael Bell

(57) ABSTRACT

The invention includes a pump having a barrel, a plunger, a seal, a fluid conduit, and a motion drive. The barrel defines an elongated chamber. The plunger includes a tip, which is disposed in the chamber. The seal sealingly engages between the chamber and the plunger, and the motion drive is configured to rotate the chamber with respect to the plunger and to translate the tip within the chamber.

20 Claims, 4 Drawing Sheets

PUMP

TECHNICAL FIELD

This invention relates to pumps and related methods for fluid handling.

BACKGROUND ART

Fluid sample analysis, such as clinical sample analysis, requires transfer of precise aliquots of fluids. Typically, syringe pumps or piston pumps provide such transfer. Miniature analysis systems require small pumps to transfer these aliquots. However, as the size of a pump and the transferred volume decreases, the precision of fluid transfer degrades, in part due to stiction. Stiction results when a force is applied between surfaces in close contact. The surfaces may adhere initially then suddenly release, producing a discontinuous motion. When the surfaces are, for example, a piston and a seal in a pump relying on piston motion for fluid transfer, the transfer of fluid may also be discontinuous. The effect is usually small, but when volumes transferred are on the order of microliters or less, stiction can contribute appreciably to transfer imprecision.

Traditional positive displacement pumps combat stiction-based imprecision by controlling seal compliance, by keeping transfer volumes high, by applying forces large enough to overcome stiction rapidly, or by some combination of these and other techniques. Because motor power, (and hence the ability to provide large forces) declines rapidly with motor size, very small pumps with good fluid transfer precision have not been available.

Miniature or portable analyzers, such as those disclosed in published application US20160023214A1 to applicant (incorporated herein by reference), require compact pumps with high precision. There is thus a need to provide fluid pumps and pumping systems that are compact and that are resistant to the effects of stiction at low fluid transfer volumes.

DISCLOSURE OF INVENTION/SUMMARY

The invention includes a pump having a barrel, a plunger, a seal, a fluid conduit, and a motion drive. The barrel defines an elongated chamber. The plunger includes a tip, which is disposed in the chamber. The seal sealingly engages between the chamber and the plunger, and the motion drive is configured to rotate the chamber with respect to the plunger and to translate the tip within the chamber.

In some embodiments, the tip is configured to translate within the chamber to a maximal depth. The chamber is constrained to rotate a plurality of times with respect to the plunger as the tip translates to the maximal depth.

In some embodiments, the plunger may include a second end and the fluid conduit may include a lumen extending through the plunger from the tip to the second end for delivering a fluid from the pump.

In embodiments, the plunger includes a first thread, and the barrel includes a second thread complementary to the first thread. The first thread engages at least a portion of the second thread.

In embodiments, the pump also includes a frame that supports the barrel. The motion drive is configured to rotate the barrel with respect to the frame.

The seal may be fixed with respect to the barrel to form a piston-style pump. In other embodiments the seal may be fixed with respect to the plunger to form a syringe-style pump.

The fluid conduit may consist of a single plumbed connection.

The motion drive may include a motor, a motion coupler, a motor driver, and a controller. The motion coupler may comprise a shaft coupling, a belt, a gear, or a linkage.

The pump may also include an anti-rotation feature or a feedback element. The anti-rotation feature may include one or more of a flat, a pin, a groove or other asymmetric geometry. The feedback element may track position of the plunger or the barrel or an amount of fluid delivered or aspirated.

In embodiments, the invention includes a pump having a lead screw, a nut, an elongated plunger, a seal, and a motion drive. The lead screw includes an external thread and an axial bore. The nut includes an internal thread engaged with the external thread of the lead screw. The elongated plunger includes a tip, and the plunger is fixed to the nut with the tip disposed in the axial bore. The seal sealingly engages between the bore and the plunger. The motion drive is configured to rotate one of the lead screw and the nut.

The pump may further include an anti-rotation feature, such as one or more of a flat, a pin, a groove. The anti-rotation feature may be arranged to prevent the nut from rotating when the lead screw rotates.

The invention also includes a method of pumping including adding fluid to a chamber, where the chamber is sealingly engaged with a plunger. The method includes steps of simultaneously rotating and translating the plunger with respect to the chamber and of dispensing a portion of the fluid through a lumen in the plunger.

In embodiments, the chamber includes a seal slidingly engaged with the plunger. The chamber may comprise a lead screw, and the plunger may comprise a nut engaged with the lead screw. The step of simultaneously rotating and translating the plunger with respect to the chamber may include rotating the lead screw.

The lumen may be plumbed to a section of translucent tubing containing a fluid interface, such as a liquid-air interface. The method may also include a step of determining a displacement of the fluid interface to confirm the fluid dispense.

DETAILED DESCRIPTION

Figure 1:
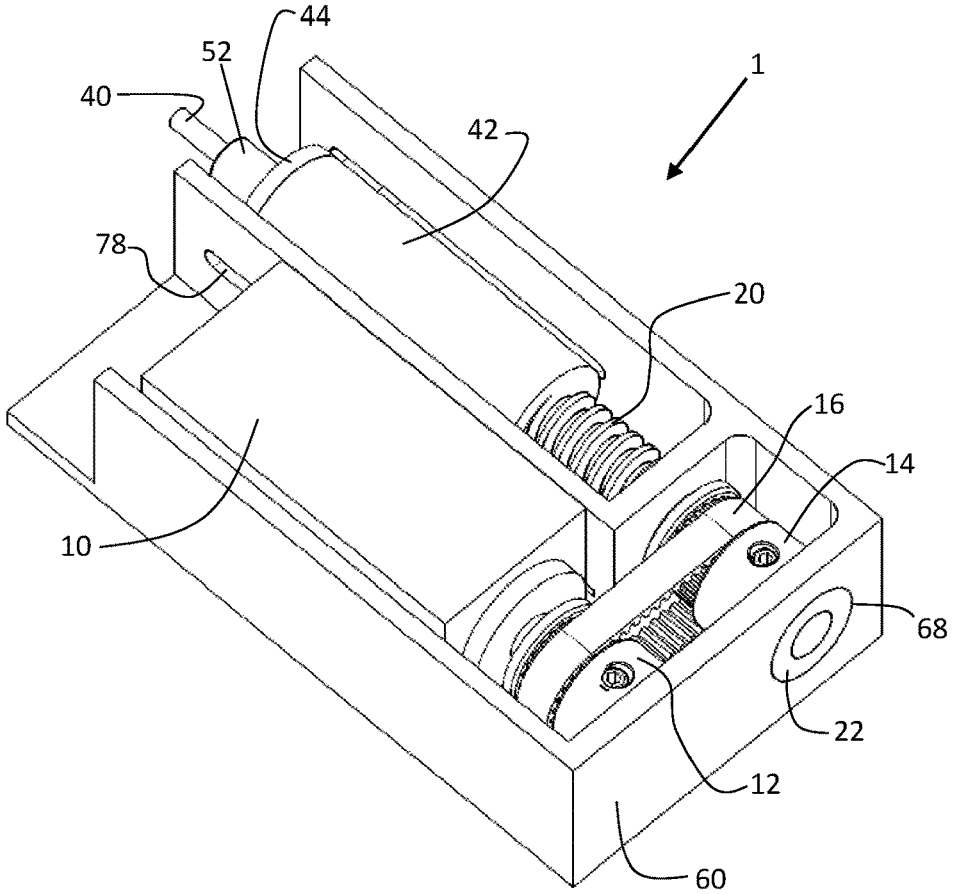
FIG. 1 shows a first perspective view of an embodiment of a pump of the invention.
Figure 2:
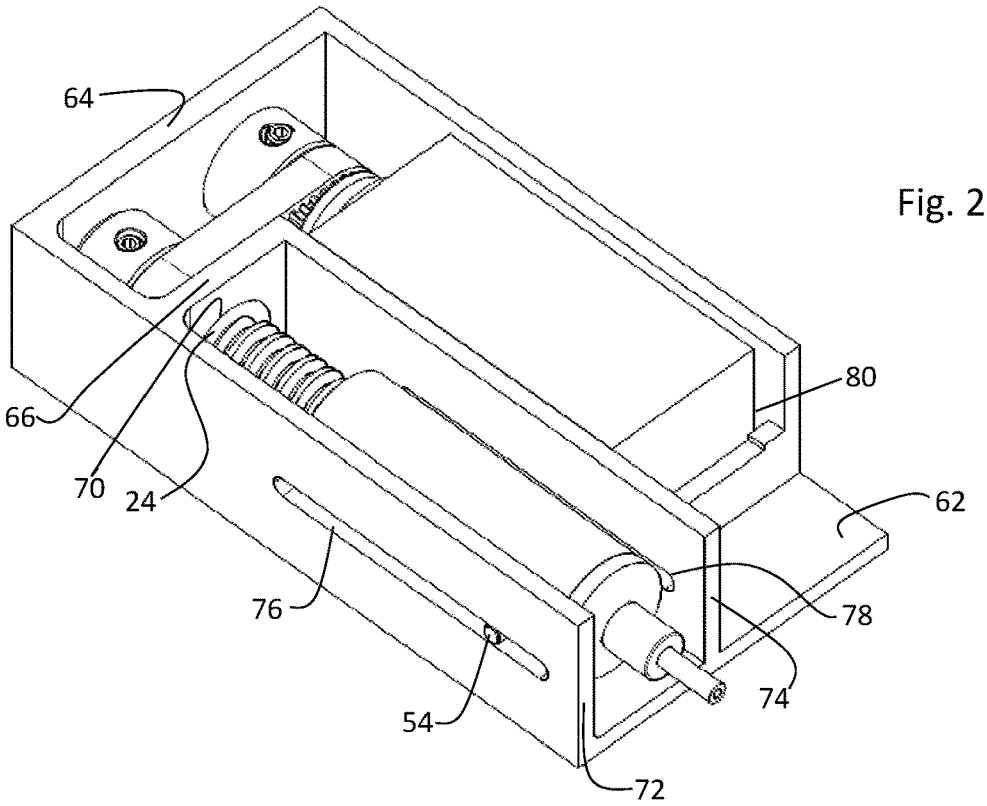
FIG. 2 shows a second perspective view of the embodiment of FIG. 1.
Figure 3:
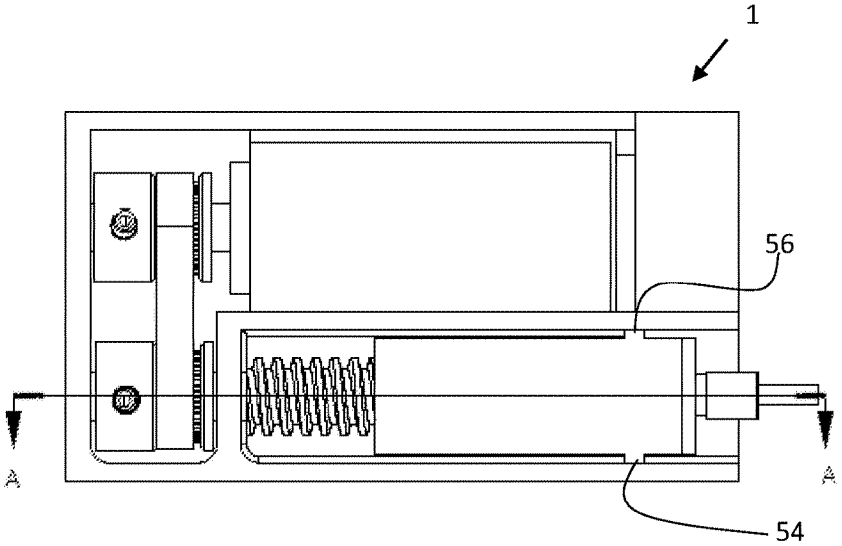
FIG. 3 shows a plan view of the embodiment of FIG. 1.
Figure 4:
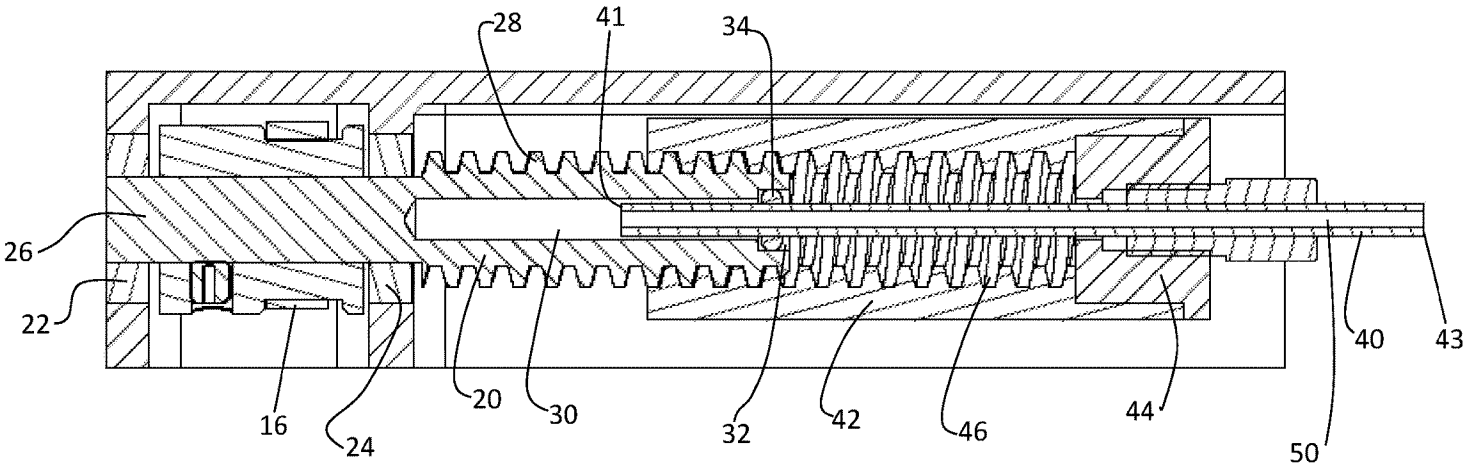
FIG. 4 shows a cross sectional view of the embodiment of FIG. 3 through a plane containing the line A-A.
Figure 5:
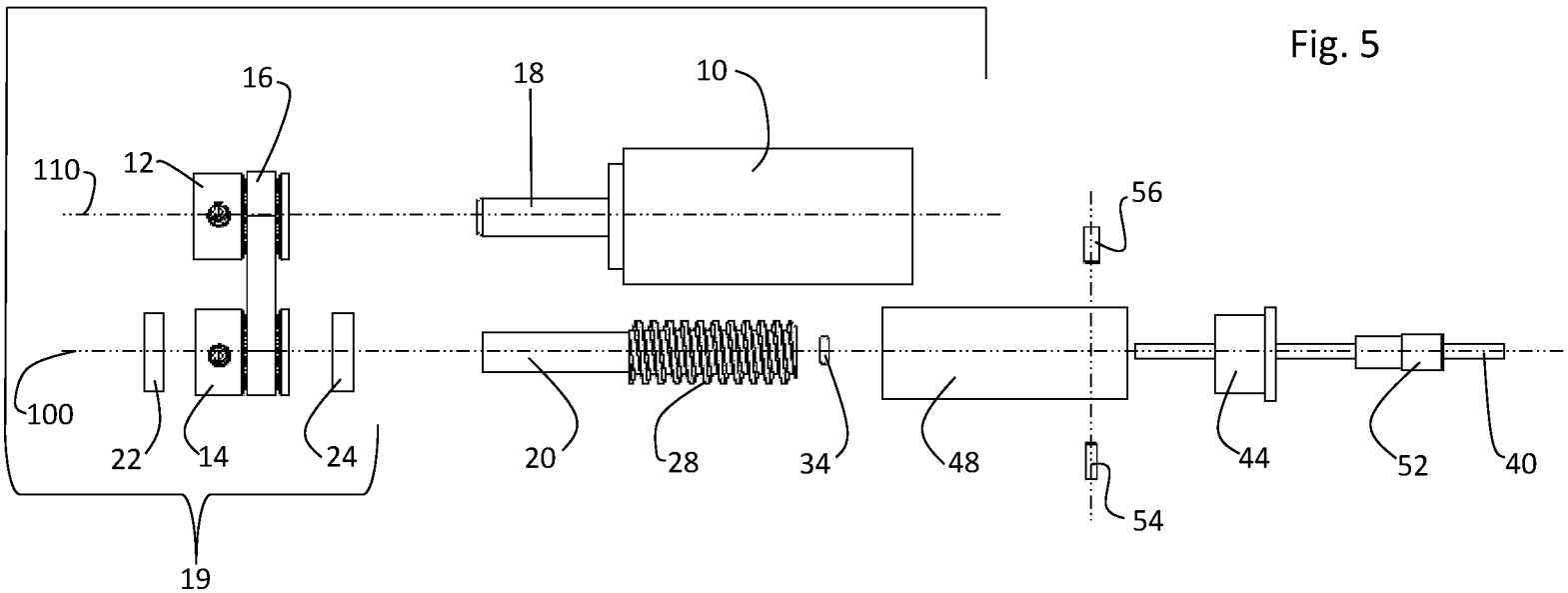
FIG. 5 shows an exploded view of the embodiment of FIG. 1.
Figure 7:
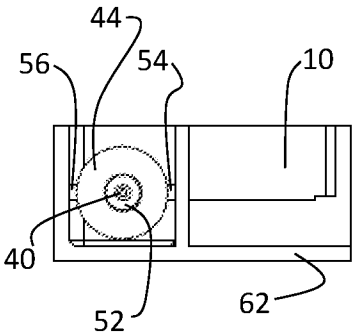
FIG. 7 shows an end view of the embodiment of FIG. 1 with the frame omitted for clarity.
Figure 6:
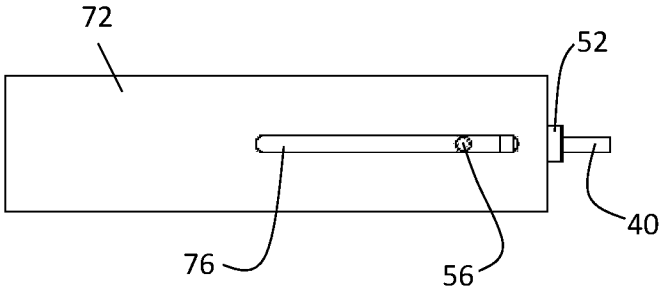
FIG. 6 shows a side view of the embodiment of FIG. 1.

The invention includes a positive displacement pump, a pumping system incorporating such a pump, and a method of transferring aliquots of fluid using such a pump. Fluids include at least liquids, gases, gels, and suspensions.

Examples of fluids include reagents, samples, diluents, wash materials, and separation fluids used in clinical analysis. Other fluids may include lubricants, adhesives, gels, foodstuffs, water, air, and other liquids and gases used in more general applications.

Positive displacement pumps advantageously provide high precision fluid transfer, particularly of fluids having relatively low compressibility, over a broad range of fluid viscosities and densities. Linear positive displacement pumps displace fluids by advancing a piston with respect to a pumping chamber, which may be disposed in a barrel. Such pumps may be divided by seal function into two types: moving seal pumps (syringe pumps) and fixed seal pumps (piston pumps). A syringe pump moves the seal during operation so that the swept volume is determined by the chamber cross sectional area. A piston pump keeps the seal stationary so that the swept volume is determined by the piston cross sectional area. The two types have different advantages. For example, the moving seal of a syringe pump can sweep the entire pumped volume free of bubbles, which might otherwise degrade pump precision. The cross-sectional area of a piston pump can be precisely controlled over the length of the piston through a process such as centerless grinding of the piston, thus providing high linearity of pumped volume versus displacement.

The pump of the invention may be configured either as a syringe pump or as a piston pump as required by the specific application. The embodiments discussed below are piston pumps, but the skilled practitioner will readily ascertain modifications necessary to change the fixed seal between the plunger and the chamber into a seal that moves with the plunger and seals against the walls of the chamber to create a syringe pump. Such a syringe pump may have a discrete seal mounted to the plunger near its tip. A variant of the syringe pump may have an integral seal with the plunger outside diameter closely fitted to the chamber inside diameter; this is a hybrid design in that the piston cross sectional area is essentially the same as the chamber cross sectional area.

In the embodiments described below, motion is divided between a lead screw and a plunger, with the plunger connected to a nut engaged with the lead screw. This design advantageously fixes the connection of a non-translating component to the motion drive. In other embodiments, the lead screw may be fixed with a motor driving rotation of the nut about the lead screw threads. This design requires the motion drive to engage a translating part, presenting some mechanical complications. Such designs may nonetheless be preferable in some applications because the fixed lead screw permits simpler plumbing of one or more fluid connections. These simpler connections may aide pump priming and cleanout in some applications.

In embodiments, the pump of the invention may be a positive displacement pump such as pump 1 illustrated in FIGS. 1 through 7. Pump 1 includes plunger 40, lead screw 20, seal 34, nut 42, motor 10, and frame 60. Lead screw 20 includes an axially disposed chamber 30. Pump 1 operates by moving plunger 40 within lead screw 20, where plunger 40 seals to lead screw 20 within chamber 30 via seal 34 to create a pumping volume.

Plunger 40 moves with respect to the pumping volume by both rotating and translating. The plunger moves in a spiral path with its axial translation providing the pumping action. Without intent to be bound by theory, applicant believes that the rotation helps to reduce the effect of stiction between plunger 40 (or lead screw 20 in syringe pump embodiments) and seal 34 by breaking adhesions between plunger 40 and seal 34 on a small axial scale. This breaking of adhesion advantageously reduces the effect of stiction of pumped volumes by extending the distance of relative seal motion through the spiral path. The rotation does not affect the adhesion directly but provides a longer spiral path to break the adhesions. Since the transferred volume only depends on the axial travel distance, any abrupt movement has a much smaller effect on transfer precision than if plunger rotation were not present.

The effectiveness of the reduction in stiction may depend on the pitch of the lead screw. Finer pitches suffer less pronounced stiction effects than coarser pitches and provide a higher resolution of dispense volumes. But finer pitches generally decrease lead screw efficiency, reducing motor torque margins. Fine pitches also produce slower fluid transfers because more motor rotations are required. A lead screw pitch of 5 to 80 threads per inch produces an effective reduction in stiction-induced imprecision for transfer of volumes of about 0.05 to 20 microliters using commercially available motors. A lead screw pitch of about 10 to 30 threads per inch delivers reasonably rapid fluid transfer speed in these volume range with suitable resolution.

The reduced stiction improves pumping precision by reducing jerky motion between the parts in the axial direction and consequent abrupt changes in pumping volume. This is of particular value when pumped volumes are small, such as less than 10 microliters, and especially less than 1 microliter.

In the illustrated embodiment, motor 10 rotates lead screw 20. Lead screw 20 includes an axially disposed chamber 30 with a fixed seal 34. Plunger 40 is mounted to nut 42, which engages with lead screw 20. Nut 42 is prevented from rotating. Thus plunger 40 translates axially with respect to chamber 30 while lead screw 20 rotates. The net effect is that plunger 40 translates within chamber 30 as lead screw 20 rotates. Seal 34 provides a fluid tight connection between plunger 40 and chamber 30.

As plunger tip 41 advances deeper into chamber 30 (in the direction of the blind end of chamber 30), plunger 40 occupies a greater portion of the volume of chamber 30, displacing fluid from chamber 30. When motor 10 reverses direction, plunger 40 retreats from chamber 30, occupying a smaller portion of chamber 30. This retreating motion acts to aspirate fluid into chamber 30.

In the illustrated embodiment, lumen 50 extends axially through plunger 40 to provide a fluid conduit for the pump to aspirate or dispense fluid. The displaced fluid exits chamber 30 through lumen 50. Aspirated fluid enters chamber 30 through the same lumen 50. Plunger 40 may thus be a tube with transfer volume proportional to its cross-sectional area and to the distance advanced. This tubular construction advantageously reduces the volume transferred (as compared to a solid plunger), allowing finer resolution in transferred volume for each rotation of motor 10. The tubular construction also advantageously reduces the contact area per unit of pumped volume between plunger 40 and seal 34, thereby further reducing the effect of stiction on transfer imprecision.

Because plunger 40 translates, plunger end 43 (opposite to plunger tip 41) also moves. Connection of pump 1 to other devices needs a connection that is tolerant of this motion. Such a connection may be provided by a flexible length of tubing, a sliding seal, or other method.

In other embodiments, chamber 30 may have an alternative plumbed connection as a fluid conduit (not shown) for ingress or egress of fluids. For example, a small channel may extend axially from the end of chamber 30 shown as blind in the cross-sectional view of FIG. 4 through drive portion 26 of lead screw 20. Such a channel may terminate in a rotating seal for connection to other parts of the system. Such embodiments advantageously provide a fluid conduit that does not translate during operation of pump 1, simplifying the pump connection. In still other embodiments, both the channel and lumen 50 may be present to simplify purging or cleanout of chamber 30. In other embodiments, plunger 42 may have a second lumen (not shown) parallel to lumen 50 to assist with purging or cleanout.

Embodiments with a single fluid conduit (either through lumen 50 or through a channel through drive portion 26 as described above or otherwise) advantageously reduce plumbing complexity and avoid retention of fluids in unused passageways. Such retained fluids can degrade pump performance, particularly if the fluids include appreciable gas components. Thus, the invention also contemplates embodiments of a pump as described with only a single fluid connection. In such embodiments, multiple fluid connections from chamber 30 are expressly excluded.

Lead screw 20 comprises an elongated lead screw having chamber 30 extending axially along a portion of the length of the lead screw. Lead screw 20 may comprise stainless steel or other dimensionally stable material that is chemically resistant to the fluids to be pumped. In some embodiments, the fluid-contacting surface of lead screw 20 may be passivated, coated, or lined to enhance chemical resistance and surface finish. Chamber 30 may be contiguous with a seal recess 32 where seal recess 32 forms a counterbore to chamber 30.

In embodiments, lead screw 20 has a threaded portion for driving nut 42 and a nonthreaded drive portion 26 having a cylindrical surface. Chamber 30 may be formed in lead screw 20 as a blind hole along the axis of lead screw 20 with a shallow counterbore. The configuration of chamber 30 within lead screw 20 advantageously reduces the overall length of pump 1. This is particularly important in applications that are handheld or in applications where multiple pumps are required.

In embodiments, lead screw 20 may be a ¼-20 stainless steel lead screw with chamber 30 blind drilled, reamed, and passivated. In other embodiments, lead screw 30 may be drilled completely through to provide the alternative or additional channel as a fluid conduit as described above.

Seal recess 32 accommodates a seal 34 in sealing relationship between lead screw 20 and plunger 40. Seal 34 may be an O-ring or similar seal such as a quad ring or spring-energized seal sized to seal between lead screw 20 and plunger 40. In other embodiments, seal 34 may include an extended seal closely approximating the outside diameter of plunger 40, such as that described in US20050042120A1 to Kittock, incorporated by reference herein for this disclosure. Seal 34 may be retained within seal recess 32 by friction, by a fastener, or by adhesive.

In embodiments, seal 34 may include a region of near contact between plunger 40 and chamber 30. Such a seal may be produced by, for example, lapping plunger 40 and chamber 30 with successively finer abrasives. Alternatively, chamber 30 may include an adhered liner of material, such as precision bore glass, that may be close fitted to plunger 40 (or to a mandrel of similar dimension and finish) by heat treatment or etching. Such techniques are well known in the art of gas-tight syringe manufacture.

Plunger 40 may be manufactured of any of a number of dimensionally stable materials that are chemically compatible with the fluid to be pumped. In some embodiments, plunger 40 may be polyether ether ketone (PEEK), a high strength engineering plastic. In other embodiments, plunger 40 may be formed of ceramic, glass, stainless steel, chemically resistant metals or polymers, or other materials that combine strength, dimensional stability, and chemical resistance.

Lead screw 20 includes external threads 28 over at least part of the length of lead screw 20. External threads 28 interact with the complementary internal threads 46 of nut 42. In some embodiments, lead screw 20 and nut 42 may comprise a recirculating ball nut assembly to reduce friction and backlash. In other embodiments, these elements may include helical, ACME-style, or other conventional threads. External threads 28 may be coated to reduce friction. A recirculating ball nut assembly advantageously combines low backlash and high efficiency, but these products are more expensive and require more space than comparably sized conventional lead screws.

Threads in relative rotation may produce backlash, a lack of precise motion tracking when rotation direction changes. A variety of of methods are known in the art to reduce or eliminate such backlash. Nut 42 may include spacers or spring elements (not shown) to bias nut 42 against external threads 28 to reduce or eliminate backlash. Alternatively, the pump may eliminate or reduce backlash by providing additional rotation when changing the direction of rotation. This "soft" backlash correction may be adjusted over the length of lead screw 20 to correct for thread non uniformities.

Nut 42 maybe formed of any of a variety of materials compatible with external threads 28. In some embodiments, nut 42 may include a lubricant loaded polymer, such as a polyacetal. Nut 42 does not contact pumped fluid during normal operation, so chemical resistance is less important but is still desirable in case of spills or leaks.

Nut 42 may be connected to plunger 40 via cap 44 and fitting 50. Cap 44 is rigidly connected to nut 42. These may be produced as separate parts to simplify manufacture. Cap 44 is pierced to accommodate plunger 40. Plunger 40 may be rigidly connected to cap 44 via fitting 50, which may be a standard tubing fitting sized to fit plunger 40. The assembly of nut 42, cap 44, fitting 52, and plunger 40 may be threaded onto lead screw 20. Cap 44 serves to align plunger 40 with seal 34 and chamber 30. Lead screw 20 may include funnel features (not shown) to facilitate this alignment.

Motor 10 drives the relative motion of plunger 40 and lead screw 20. Motor 10 may be a rotary stepping motor such as model SH2141 available from Sanyo Denki Co., Ltd. of Tokyo, Japan. A stepping motor advantageously rotates through a controllable angle (corresponding to a controlled dispense amount) with simple drive circuitry and provides holding torque that prevents unintended motion.

In other embodiments, motor 10 may include a DC motor or a synchronous motor with a feedback element such as an encoder or resolver driven as a positioning servo. The use of a feedback element advantageously confirms whether commanded motion occurs, identifying some fluid transfer errors.

In any embodiment, the piston pump may include a feedback element 230 (see FIG. 8) to confirm motion of plunger 40 with respect to lead screw 20. Such linear feedback elements are well known and include at least optical, magnetic, contact, and resistance-based linear encoders. A linear feedback element may be used in a positioning servo loop or may serve as an indicator of actual motion. Alternatively, a feedback element may include a camera to track the position of a moving component (such as plunger 40) or of a portion or boundary of pumped fluid visible through translucent tubing downstream of plunger 40. Advantageously, such a feedback element may identify or correct for deviations in piston travel irrespective of backlash, motion train compliance, or friction between components to accurately quantify piston or fluid motion and hence actual fluid delivery during pumping.

Motor 10 is coupled to lead screw 20 so that lead screw 20 rotates as motor shaft 18 of motor 10 rotates. In some embodiments lead screw 20 couples directly to motor shaft 18, but motor 10 may alternatively be indirectly coupled to lead screw 20 through intermediate elements such as gears, pulleys, or belts. Motion drive 19 comprises motor 10 and associated motion coupling components.

As illustrated in FIGS. 1 through 7, motion drive 19 comprises motor 10, drive pulley 12, belt 16, and driven pulley 14. Motor shaft 18 of motor 10 is affixed to drive pulley 12. Drive pulley 12 may be a timing pulley, such as a 1 mm pitch pulley available from Designatronics Inc. of Hicksville, N.Y. Drive belt 16 meshes with drive pulley 12 and with driven pulley 48 mounted to lead screw 20. Rotation of motor shaft 18 produces rotation of lead screw 20 through drive pulley 12, belt 16, and driven pulley 48. Drive pulley 12 may have equal number of teeth as driven pulley 14. In other embodiments, a different number of teeth allows amplification of torque or of rotation velocity in proportion to the relative number of teeth on each pulley. A larger number of teeth on drive pulley 12 than on driven pulley 14 increase relative rotation of lead screw 20 with respect to drive pulley 12. A smaller number of teeth on drive pulley 12 than on driven pulley 14 increases torque applied to driven pulley 14 while reducing relative rotation. A skilled practitioner can select the desired number of teeth on each pulley to match the components employed.

In the illustrated embodiment, motor 10 is disposed parallel to lead screw 20 and nut 42. This reduces the overall length of pump 1, which may be suitable for some applications. This "folded" embodiment also gives access to the end of drive portion 26 of lead screw 20 for alternative plumbing connections described above. Drive portion 26 may lack external threads for easier coupling. In the embodiment, lead screw 20 may be supported by first bearing 22 and second bearing 24. These bearings may be ball bearings or other bearings known in the art. As illustrated, first bearing 22 and second bearing 24 are separated axially by a segment of drive portion 26. This segment holds driven pulley 14. Alternatively, two or more bearings may be placed adjacent one another, or a single bearing may be used, but the illustrated embodiment provides better support against side loads from belt 16.

As lead screw 20 rotates, lead screw 20 translates with respect to nut 42. In some embodiments, nut 42 may be fixed with respect to frame 60 so that lead screw 20 and motor 10 translate with respect to frame 60 as motor shaft 18 rotates. In other embodiments, different components may be fixed to provide relative motion between lead screw 20 and nut 42. As illustrated, motor 10 and lead screw 20 are fixed to frame 60 to prevent translation of these components. Nut 42, together with attached plunger 40, translate with respect to frame 60 as motor 10 and lead screw 20 rotate.

The various parts may be arranged and mounted in a frame 60. Frame 60 includes a substantially planar base 62 and various walls (e.g. end wall 64, second wall 88, side wall 72, and parallel wall 74) extending perpendicularly from base 62. In the illustrated embodiment, base 62 has a rectangular outline with a long side and a short side. End wall 64 extends from one short side and includes a first bearing recess 68 sized to fit first bearing 22. Second wall 88 extends from base 60 parallel to and spaced apart from end wall 64. Second wall 88 includes a second bearing recess 70 sized to fit second bearing 24.

Side wall 72 extends from one long side of base 62 and includes a first slot 76. Parallel wall 74 extends from base 60 parallel to and spaced apart from side wall 72. Parallel wall 74 includes a second slot 78.

Frame 60 includes features to mount other components of pump 1. In embodiments, motor 10 defines motor axis 110 concentric with motor shaft 18. Motor 10 is retained in motor recess 80, which may penetrate base 62. Components may be mounted to frame 60 in a conventional manner. For example, motor 10 may be held in motor recess 80 with screws; first bearing 22 may be press fit to first bearing recess 68; second bearing 24 may be press fit to second bearing recess 70. First bearing 22 and second bearing 24 are aligned, with their centerlines defining a pump axis 100 (visible in FIG. 5). Side wall 72 and parallel wall 74 are disposed on either side of pump axis 100. First slot 76 and second slot 78 extend parallel to pump axis 100.

Other components mount indirectly to frame 60. For example, lead screw 20 may be press fitted to the inner races of first bearing 22 and second bearing 24 to align lead screw 20 with pump axis 100. Driven pulley 14 may be fastened to drive portion 26 of lead screw 20 between first bearing 22 and second bearing 24. Drive pulley 12 is fastened to motor shaft 18. Components may be mounted to one another by conventional methods, such as interference fits, adhesives, set screws, or pins as appropriate to the part. For example, the two pulleys may be fastened to their respective shafts by a set screw, pin, clamp, or similar method.

Embodiments feature relative rotation and translation of lead screw 20 and nut 42. This requires that at least one part (nut 42 in the illustrated embodiment) be prevented from rotating with respect to frame 60. Anti-rotation features are well known in the art. These typically exploit asymmetries in the geometry of the parts. For example, nut 42 may be prevented from rotating by inclusion of radially asymmetric geometry, such as a flat, a slot, a pin, or a hole in nut 42. In the illustrated embodiment, frame 60 includes side wall 72 and parallel wall 74 disposed parallel to side wall 72. Side wall 72 is penetrated by a first slot 76; parallel wall 74 includes a second slot 78. First slot 76 and second slot 78 are disposed parallel to one another.

Nut 42 may have a generally cylindrical outer profile and includes first pin 54 and second pin 56 extending radially outwardly in opposite directions from the cylindrical surface. First pin 54 rides in first slot 76. Second pin 56 rides in second slot 78. The pins closely approximate the edges of their respective slots to prevent rotation of nut 42. The pins may also advantageously serve to support the free end of nut 42.

In other embodiments, a single longer pin may project through a deeper slot, so that only one pin is required. In still other embodiments, nut 42 may be supported by a linear bearing. Other anti-rotation alternatives would be readily apprehended by a skilled practitioner.

Figure 8:
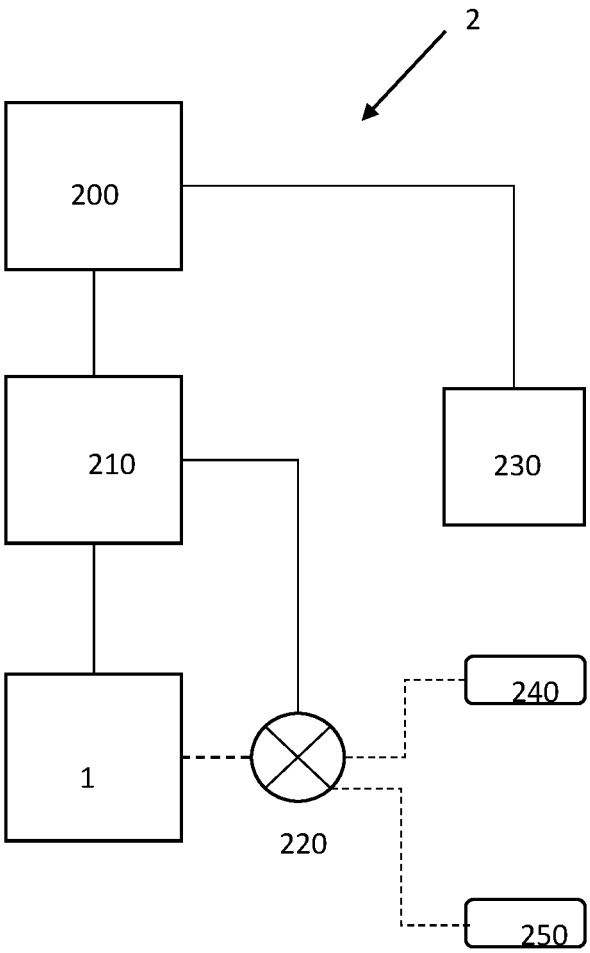
FIG. 8 shows a block diagram of connection of the controller in a pumping system embodiment of the invention.

The block diagram of FIG. 8 illustrates a pumping system 2 of the invention incorporating pump 1 as described above. Pumping system 2 includes pump 1 plus controller 200, driver 210, and, optionally, valve 220 and feedback element 230. Solid lines indicate electrical connections. Dashed lines indicate fluid connections. Pumping system 2 is shown fluidically coupled to fluid source 240 and to fluid destination 250.

Controller 200 may be an electrical controller such as a microprocessor, a microcomputer, a gate array, or similar device known in the art. In embodiments, controller 200 may be a single-chip microcontroller such as the PIC 18F25K83 manufactured by Microchip Technology Inc. of Chandler, Ariz. or a board-level microcontroller such as a Raspberry Pi 3 Model B+ single board computer developed by the Raspberry Pi Foundation of the United Kingdom, or the Arduino MKR WiFi 1010 developed by U-BLOX of Thalwil, Switzerland. Controller 200 is programmed to execute a sequence of steps that operate pumping system 2. The programming of electronic devices such as controller 200 is well known in the art. Controller 200 may also include interface electronics for communicating (either directly or wirelessly) with other devices, such as an analyzer controller when the pumping system is incorporated into a clinical analyzer. Controller 200 may also optionally include indicators such as visible LEDs or a display, real time clock functionality to define the timing of events, and memory storage to record calibration information or backlash correction.

In embodiments, controller 200 controls the operation of the various parts. The discussion that follows refers to operations performed by the pumping system or by a component of the pumping system. These references refer to control by the controller as mediated by appropriate drivers 210 and by software known in the art. Driver 210 translates between logic level signals of controller 200 and the required signals of other components such as motor 10 and valve 220.

In operation, pump system 2 may receive commands from an external device, such as an analyzer controller as described above. In some embodiments, controller 200 may share components with such an external device so that the controller function operates as a subprocess or thread on a more extensive system. Alternatively, pump system 2 may operate from a stored set of operations or protocols.

Pump system 2 may transfer fluids in a series of operations. The following discussion focuses on transfer of substantially incompressible liquids using the mechanical embodiment of FIGS. 1-7, but the skilled practitioner may readily apprehend how such steps may be modified to adjust for alternative mechanical embodiments or for compressible fluids. As discussed above, translation of plunger 40 that moves tip 41 deeper into chamber 30 displaces fluid from chamber 30 and through lumen 50. Lumen 50 may be plumbed to a multiport valve 220, which may be a shear valve to reduce dead volume. Valve 220 operates under control of controller 200 as mediated by driver 210. One side of valve 220 is plumbed to lumen 50. Valve 220 operates under program control to selectively couple lumen 50 to one of fluid source 240 or fluid destination 250. Selectively couple here means that lumen 50 (and indirectly chamber 30) is fluidically connected to only the selected one of fluid source 240 or fluid destination 250. For example, when valve 220 is operated to connect lumen 50 to fluid source 240, then fluid source 240 but not fluid destination 250 is fluidically connected to lumen 50 and to chamber 30.

When operating pump system 2, controller 200 may first position valve 220 to connect to fluid source 240. Controller 200 then rotates motor 10 to retract plunger 40 so that tip 41 is less deep in chamber 30, thereby aspirating a desired volume of fluid into chamber 30. An equivalent volume of fluid from fluid source 240 advances at least into the fluid line connecting valve 220 to fluid source 240. In some applications, the aspirated fluid may enter valve 220, the connection between valve 220 and plunger 40, lumen 50, or even chamber 30.

In general, it is desirable to limit entry of pumped fluids into valve 220 to prevent contamination of valve 220. This is possible in applications such as traditional clinical analyzers that include additional hardware for selection of fluid sources and destinations. Clinical analyzers may use a movable probe to select fluid locations. In applications lacking such additional hardware, such as that of published application US20160023214A1 cited above, aspirated fluid may enter valve 220 and the connection between valve 220 and plunger 40. Even in such applications, it may be desirable to avoid aspirating any fluid other than air, clean water, or a defined pumping fluid of controlled characteristics into lumen 50 or chamber 30. This prevents contamination of pumping system 2 and reduces cleanout requirements.

Once the fluid has been aspirated, controller 200 may position valve 220 to connect to fluid destination 250. Controller 200 then rotates motor 10 (in the opposite direction to the aspirate step) to advance plunger 40 so that tip 41 is deeper in chamber 30 a desired distance, thereby dispensing a desired volume of fluid from chamber 30. An equivalent volume of fluid from valve 220 (or the connection between valve 220 and plunger 40) advances at least into the fluid line connecting valve 220 to fluid destination 250.

If pumping system 2 uses soft backlash correction, controller 200 may rotate motor 10 a predetermined number of additional steps to take up backlash from the interaction of lead screw 20 and nut 42.

Pumping system 2 may include feedback element 230. Feedback element may include a rotary encoder, a linear encoder, or a fluid sensor. A rotary encoder may be connected to motor 10 as a servo feedback for controlling the operation of motor 10. Alternatively, a rotary encoder may serve to verify whether a commanded motion of motor 10 successfully occurred. If a commanded motion was not successful, controller 200 may enter an error handling routine to correct or communicate the problem.

A linear encoder may monitor the position of a translating part, such as nut 42 or plunger 40. Controller may compare the reported position of any such part against the commanded motion. If a commanded motion was not successful, controller 200 may enter an error handling routine to correct or communicate the problem.

A fluid sensor may include any of a number of fluid sensors known in the art such as a conductivity sensor, a capacitive sensor, or an optical sensor to determine the location of a portion of fluid. This is most useful when the fluid includes regions of liquid separated by bubbles or other relatively immiscible materials. An appropriate sensor can track the position (or timing) of an interface between liquid and a bubble. For example, when pumping system 2 includes fluid connections composed of translucent tubing, the fluid sensor may be a camera with a field of view encompassing a section of such tubing. The camera can form an image of a liquid interface and track its change of position within the tubing. Controller 200 then determines from the image (or a set of images) whether the amount of fluid motion matches that commanded. If a commanded fluid motion was not successful, controller 200 may enter an error handling routine to correct or communicate the problem.

Figure 9:
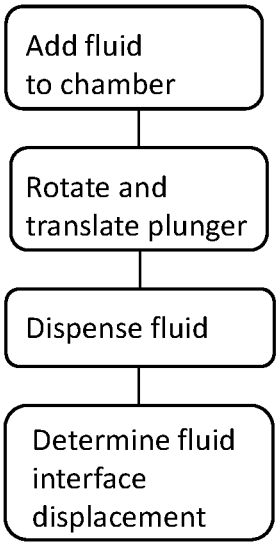
FIG. 9 shows a diagram of a method of the invention.

In summary as illustrated in FIG. 9, one method of the invention adds fluid to chamber 30, which is sealingly engaged with plunger 40. Plunger 40 is rotated and translated with respect to chamber 30, dispensing a portion of the fluid through lumen 50 in plunger 30. The simultaneous rotation and translation of plunger 40 with respect to chamber 30 may include rotating lead screw 20 using motor 10. Lumen 50 may be plumbed to a section of translucent tubing containing a fluid interface, such as a liquid-air interface.

Controller 200 may work with a feedback element 230, such as a camera, to determine a displacement of the fluid interface to confirm the fluid dispense.

The embodiments described herein are referred in the specification as "one embodiment," "an embodiment," "another embodiment," etc. These references indicate that the embodiment(s) described can include a particular feature, structure, or characteristic, but every embodiment does not necessarily include every described feature, structure, or characteristic. Further, when a particular feature, structure, or characteristic is described in connection with an embodiment, such feature, structure, or characteristic in may also be used in connection with other embodiments whether or not explicitly described.

Further, where specific examples are given, the skilled practitioner may understand the particular examples as providing particular benefits such that the invention as illustratively disclosed herein suitably may be practiced in the absence of any element which is not specifically disclosed herein or within that particular example.

This disclosure mentions certain other documents incorporated by reference. Where such documents conflict with the express disclosure of this document, this document controls.

It will be apparent to those of ordinary skill in the art that many modifications and variations of the described embodiment are possible in the light of the above teachings without departing from the principles and concepts of the disclosure as set forth in the claims.

Although the present disclosure describes certain exemplary embodiments, it is to be understood that such disclosure is purely illustrative and is not to be interpreted as limiting. Consequently, without departing from the spirit and scope of the disclosure, various alterations, modifications, and/or alternative applications of the disclosure will, no doubt, be suggested to those skilled in the art after having read the preceding disclosure. Accordingly, it is intended that the following claims be interpreted as encompassing all alterations, modifications, or alternative applications as fall within the true spirit and scope of the disclosure.

I claim:

1. A pump comprising:

a lead screw including an external thread and an axial bore;

a nut including an internal thread engaged with the external thread;

an elongated plunger including a tip, the plunger fixed to the nut and the tip disposed in the bore;

a seal sealingly engaged between the bore and the plunger;

a fluid conduit plumbed to the bore; and a motion drive configured to rotate one of the lead screw and the nut.

2. The pump of claim 1, further comprising an anti-rotation feature.

3. The pump of claim 2, wherein the anti-rotation feature includes one or more of a flat, a pin, and a groove.

4. The pump of claim 3, wherein the motion drive rotates the lead screw, and wherein the anti-rotation feature prevents the nut from rotating.

5. The pump of claim 4, wherein the anti-rotation feature includes a pin mounted to the nut.

6. The pump of claim 5, wherein the seal is slidingly engaged with the plunger.

7. A method of pumping a fluid, comprising a) adding a fluid to an axial bore of a lead screw, the bore sealingly engaged with a plunger;

b) simultaneously rotating and translating the plunger with respect to the bore; and c) dispensing a portion of the fluid through a conduit plumbed to the bore.

8. The method of claim 7, wherein the, conduit comprises a lumen in the plunger.

9. The method of claim 8, wherein the lumen is plumbed to a section of translucent tubing containing a fluid interface, the method further comprising determining a displacement of the fluid interface to confirm the fluid dispense.

10. A pump comprising:

a lead screw including an external thread and an axial bore;

an elongated plunger disposed in the bore;

a seal sealingly engaged between the bore and the plunger; and a fluid conduit plumbed to the bore.

11. The pump of claim 10, wherein the plunger includes a tip disposed within the bore, the tip configured to translate within the bore to a maximal depth, and wherein the lead screw is constrained to rotate a plurality of times with respect to the plunger as the tip translates to the maximal depth.

12. The pump of claim 11, wherein the plunger includes a second end, and wherein the fluid conduit comprises a lumen extending through the plunger from the tip to the second end.

13. The pump of claim 10, further comprising a nut having an internal thread engaged with the external thread, the nut secured to the plunger.

14. The pump of claim 10, wherein the seal is fixed with respect to the lead screw or with respect to the plunger.

15. The pump of claim 10, further comprising a frame supporting the lead screw and a motion drive configured to rotate the lead screw with respect to the frame.

16. The pump of claim 15, wherein the motion drive includes a motor, a motion coupler, a motor driver, and a controller, wherein the motion coupler comprises a shaft coupling, a belt, a gear, or a linkage.

17. The pump of claim 16, further comprising an anti-rotation feature.

18. The pump of claim 10, further comprising a feedback element to track position of the plunger or of the lead screw or of an amount of fluid delivered or aspirated.

19. The pump of claim 10, wherein the fluid conduit consists of a single plumbed connection.

20. The pump of claim 10, wherein the fluid conduit includes a hole in the lead screw communicating with the bore.

* * * * *